US005479558A

United States Patent [19]

White, Jr. et al.

[11] Patent Number: 5,479,558

[45] Date of Patent: Dec. 26, 1995

[54] FLOW-THROUGH TANKLESS WATER HEATER WITH FLOW SWITCH AND HEATER CONTROL SYSTEM

[76] Inventors: James A. White, Jr., 90 Veys Dr.; David D. Gillaspie, 589 Rose Valley Rd., both of Kelso, Wash. 98626

[21] Appl. No.: 113,098

[22] Filed: Aug. 30, 1993

[51] Int. Cl.[6] ..... F24H 1/00

[52] U.S. Cl. ..... 392/485; 219/509; 219/497

[58] Field of Search ..... 392/485–492; 219/497, 486, 509; 122/13.2, 448.3, 4 A

[56] References Cited

U.S. PATENT DOCUMENTS

| | | | |
|---|---|---|---|
| 1,221,106 | 4/1917 | Stranszky | 392/485 |
| 1,671,584 | 5/1928 | Hicks et al. | 392/485 |
| 1,704,627 | 3/1929 | Osterheld | 392/485 |
| 1,916,066 | 6/1933 | Moyle | 392/485 |
| 3,351,739 | 11/1967 | Eckman . | |
| 3,353,000 | 11/1967 | Tomlinson | 392/485 |
| 3,560,706 | 2/1971 | Fonseca | 392/485 |
| 3,795,789 | 3/1974 | Malzoni et al. . | |
| 4,395,618 | 7/1983 | Cunningham | 392/492 |
| 4,459,465 | 7/1984 | Knight . | |
| 4,567,350 | 1/1986 | Todd, Jr. . | |
| 4,604,515 | 8/1986 | Davidson . | |
| 4,638,137 | 1/1987 | Dytch et al. . | |
| 5,020,127 | 5/1991 | Eddas et al. . | |
| 5,129,034 | 7/1992 | Sydenstricker . | |
| 5,216,743 | 6/1993 | Seitz | 392/490 |
| 5,325,822 | 7/1994 | Fernandez | 392/491 |

FOREIGN PATENT DOCUMENTS

| | | | |
|---|---|---|---|
| 1073656 | 1/1960 | Germany | 382/485 |
| 4103373 | 8/1992 | Germany . | |
| 5-168145 | 7/1993 | Japan . | |
| 1651049 | 5/1991 | U.S.S.R. | 392/492 |
| 471730 | 9/1937 | United Kingdom . | |
| 2140990 | 12/1984 | United Kingdom | 392/485 |

*Primary Examiner*—John A. Jeffery
*Attorney, Agent, or Firm*—Richard C. Litman

[57] ABSTRACT

A very compact tankless water heater delivers heat in proportion to demand. A flow responsive valve energizing an electrical control system is purely flow responsive, even to minute flow, and consumes no power when dormant. An uncomplicated electronic control system is connected to power by the flow switch, and is substantially deenergized when dormant. Most electronic components of the control system are mounted on the flat front wall of the pressure vessel. Thus, overall dimensions are minimized, cool water serves as a heat sink, and heat generated by electronic controls is captured for heating purposes. In particular, triacs controlling the heating elements are cooled, thus prolonging their life. A preferred embodiment of the novel heater has a maximum electrical consumption of 22 kilowatts, with equivalent heat output, and has overall external dimensions of 24 inches in height, 5.5 inches in width, and 4 inches in depth (61 cm in height, 14 cm in width, and 10 cm in depth). An outlet pipe fitting extending above adds approximately 2 inches (5 cm) to the overall height, enabling the water heater to be installed in a typical building interior wall or partition.

9 Claims, 4 Drawing Sheets

FLOW-THROUGH TANKLESS WATER HEATER WITH FLOW SWITCH AND HEATER CONTROL SYSTEM

BACKGROUND OF THE INVENTION

1. Field of the Invention

The present invention relates to an electrically powered, tankless, demand responsive water heater.

2. Description of the Prior Art

Electrically operated water heaters generally are known in the prior art, and include many common features. Many of these are directed to tankless, or instantaneous, type heaters for heating water only when hot water is demanded. Energy saving benefits of such an arrangement are sufficiently discussed in the prior art, and will not be repeated herein. Examples of these patents which illustrate features relevant to the present invention include in U.S. Pat. Nos. 3,351,739, issued to Hanford L. Eckman on Nov. 7, 1967; 3,795,789, issued to Tulio Malzoni et al. on Mar. 5, 1974; 4,459,465, issued on Jul. 10, 1984 to Earl J. Knight; 4,567,350, issued on Jan. 28, 1986 to Alvin E. Todd, Jr.; 4,604,515, issued to Hal Davidson on Aug. 5, 1986; 4,638,147, issued to Anthony Dytch et al. on Jan. 20, 1987; 5,020,127, issued on May 28, 1991, to Harry Eddas et al.; 5,129,034, issued to Leonard Sydenstricker on Jul. 7, 1992; and U.K. Pat. No. 471,730, issued on Sep. 3, 1937, to Alfred Reginald Shepherd.

Eckman '739 illustrates staged energization of electrical heating elements, a step-down control circuit transformer, and a high temperature cutout switch.

Control of electric power by a flow switch, and water heaters sufficiently compact to be built into a building wall or interior partition are taught in Malzoni et al. '789, Todd, Jr. '350, and the U.K. reference '730. The flow switch disclosed in the U.K. reference includes a plunger displaced by water flow.

It is known to employ solid state switches to control electrical current to the heating elements. Examples are seen in Davidson '515 and Dytch et al . '147. The latter reference teaches mounting solid state switches on a wall of the heating chamber, thereby recovering heat generated by these switches. This reference also teaches locating a temperature sensor at the outlet of the heater.

Further location of electrical components on a flat heating chamber wall is shown in Knight '465, wherein disc type switches are featured.

The use of triacs as switches, and control of the triacs by optotriacs is shown in Davidson '515 and Eddas '127.

Sydenstricker '034 discloses a pressure control valve, a one-way check valve, a pressure relief valve, and pressure initiated heating control.

None of the above inventions and patents, taken either singly or in combination, is seen to describe the instant invention as claimed.

SUMMARY OF THE INVENTION

A tankless water heater is provided which is extremely compact, applies and discontinues electrical power in close proportion to demand for heat, eliminates voltage drop when energizing the heating elements, and which provides safety and control features which enable virtually all of the power and control circuitry to be deenergized when the heater is not actively heating water.

The particular combination of features employed herein has enabled design of a practical preferred embodiment to be realized. This preferred embodiment provides a compact package, with respect to exterior dimensions, as yet not achieved in prior art heaters of the same general heat output. A preferred embodiment provides up to 22 kilowatts of heat in four equal incremental steps of heating, yet measures only 24 inches in height, 5.5 inches in width, and 4 inches in depth (61 cm in height, 14 cm in width, and 10 cm in depth).

The design is long lived, and a model of the preferred embodiment has surpassed rigorous testing conducted by Underwriters Laboratories, Inc. (UL), and is now listed under File E142552.

The major components of the novel water heater include a box-like pressure vessel having flat sides, a water inlet at the bottom, and water outlet at the top thereof; four heating elements; and an uncomplicated yet effective electronic control system incorporating a temperature sensor and two overtemperature switches. The temperature sensor enables electrical power to be applied to the heating elements in proportion to heat requirements. The overtemperature switches are safety devices, breaking electrical connection to all downstream components in the event of excessive heating.

Switching of the heating elements is performed by triacs which are controlled by optotriacs. Thus, electrical connection of an AC power source is performed at the moment when the AC sine wave is at zero electrical potential. Momentary voltage drop, which manifests itself in flickering of household lights, and which stresses utility power transformers, is avoided.

The layout of the components is crucial in realizing the advantages of the instant water heater. The pressure vessel is tall and thin, and, due to its flat sides, many electrical components are mounted on a front wall thereof. These include the aforementioned sensor and switches, which are mounted high on the pressure vessel, so as to sense the highest temperatures attained. This layout is important since the sensor must monitor the final temperature of water exiting the heater, and since the switches must monitor the highest attained water temperature.

Located low on the pressure vessel, near the coolest portion thereof, are four triacs controlling the four heating elements. This serves the dual purpose of transferring heat from the triacs to water, thus cooling the triacs, and prolonging the life thereof, and of recapturing heat which would otherwise be lost.

A control board having a step-down control transformer and many electronic control components is also mounted on the vessel front wall. Since so many components are mounted on the front wall of the pressure vessel, overall height and width dimensions of the water heater are not increased by electrical components. Moreover, the actual control system selected results in sufficiently few and small components that the overall depth of the heater is so limited that the novel heater can be mounted inside a typical building internal wall or partition.

An important feature augmenting the layout is a water diverting baffle located in the pressure vessel. This baffle directs incoming cool water to flow directly against that portion of the vessel wall on which are mounted the triacs. Thus, the triacs are subjected to the greatest possible temperature difference, which maximizes heat transfer therefrom.

Another important feature is a pressure responsive flow switch which responds to even a very small volume of water flow. This flow switch connects power to the electrical control system. By this arrangement, two important benefits are realized. The first benefit is that when heating is not being demanded, virtually the entire control system has no voltage present. This prevents injury from electrical shocks, as by contact with exposed components, and prevents damage to sensitive electronic components, as by inadvertent shorts to ground. A second benefit is that the initiating control device consumes no power when no heating is demanded, unlike those systems requiring the initiating control device to be constantly energized in order to accomplish its monitoring function.

Accordingly, it is a principal object of the invention to provide a tankless water heater which heats water only when hot water is being used.

It is another object of the invention to provide a tankless water heater wherein energization of heating elements is sequentially accomplished.

An additional object of the invention is to provide switching controls which connect AC power to the heating elements only when the AC sine wave is at zero voltage, whereby objectionable voltage drop is avoided.

Yet another object of the invention is to provide an extremely compact tankless water heater capable of being mounted between adjacent studs in a building partition, whereby the tankless water heater is located in, and does not project from, an interior building partition.

It is a further object of the invention to provide a tankless water heater having a pressure vessel configured to present a flat surface for mounting electrical components thereon.

A still further object of the invention is to provide a tankless water heater wherein solid state power switches are mounted on the pressure vessel wall, whereby energy converted to heat by the solid state switches is transferred to water being heated, and whereby a relatively cool portion of the pressure vessel serves as a heat sink for the solid state switches.

Yet another object of the invention is to provide a tankless water heater wherein a thermally responsive cut-off switch is mounted on the relatively warmest portion of the pressure vessel.

Still another object of the invention is to provide a tankless water heater having means to direct relatively cool water against that portion of the pressure vessel acting as a heat sink.

Another object of the invention is to provide a tankless water heater wherein exposed electrical components located proximate the pressure vessel are electrically deenergized when the water heater is not heating water.

It is still a further object of the invention to provide a tankless water heater wherein the electrical control system comprises sufficiently few components as to have all components except wiring and wiring terminals located on the pressure vessel front wall.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
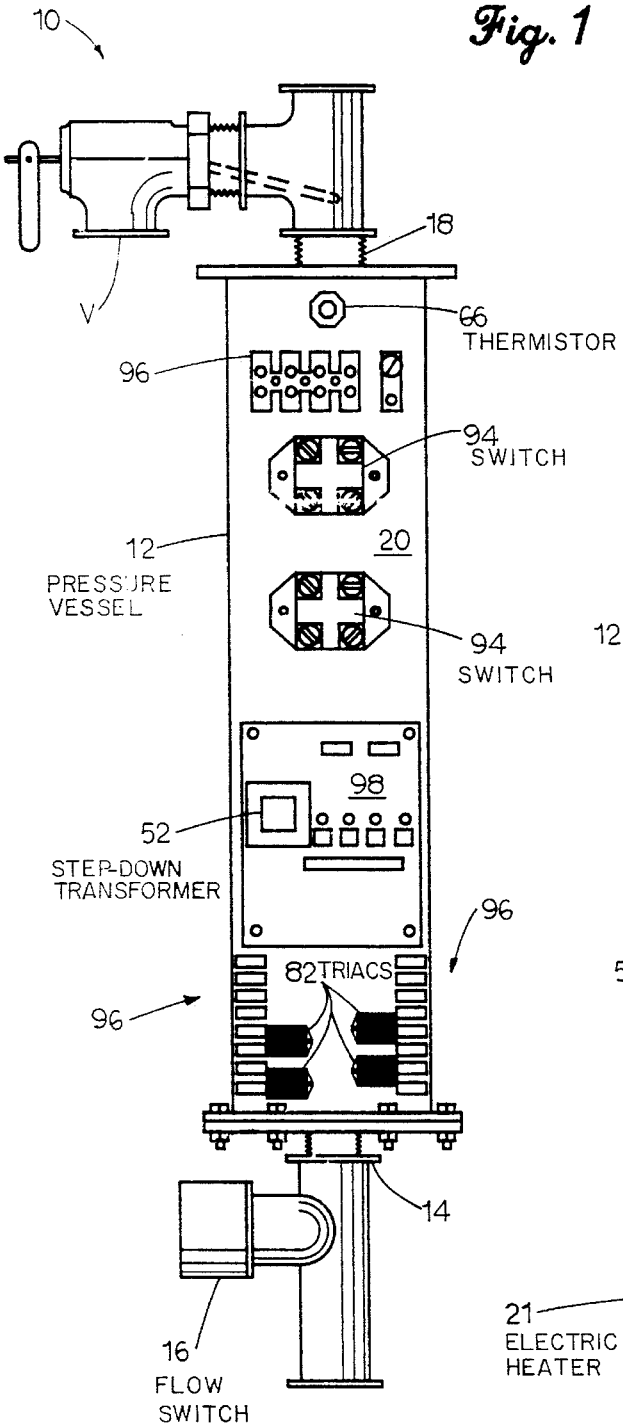
FIG. 1 is a front elevational view of the novel water heater, as assembled.

The tankless water heater 10 of the present invention is seen assembled in FIG. 1, although not including an outer enclosure or housing (not shown), and includes pressure vessel 12, inlet conduit 14, flow switch 16, and outlet conduit 18. A conventional pressure relief valve V is shown connected to outlet conduit 18. Major electrical components, which will be explained in detail hereinafter, are seen mounted on the flat front wall 20 of pressure vessel 12.

Figure 2:
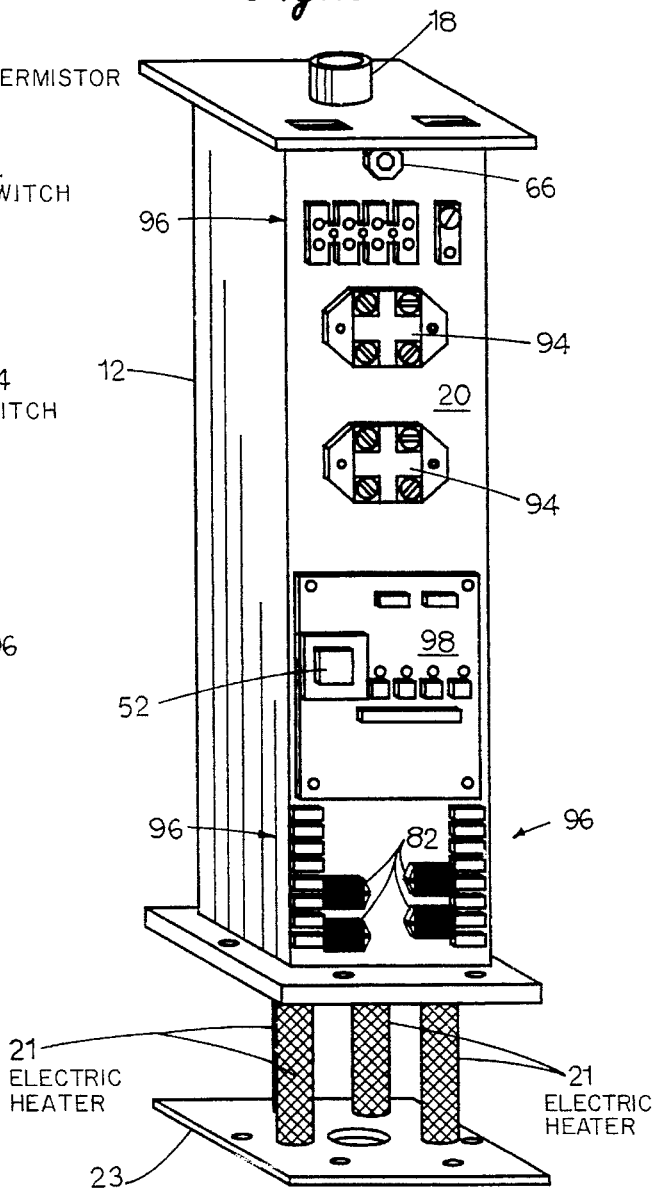
FIG. 2 is an isometric view of the pressure vessel and major electrical control components, shown partially exploded.

With reference to FIG. 2, when being used, water is heated by four heating elements 21 which extend vertically through pressure vessel 12. Heating elements 21, which are electrically powered resistive elements of known type, are installed from the bottom of pressure vessel 12, and are formed integral with flange 23.

Figure 3:
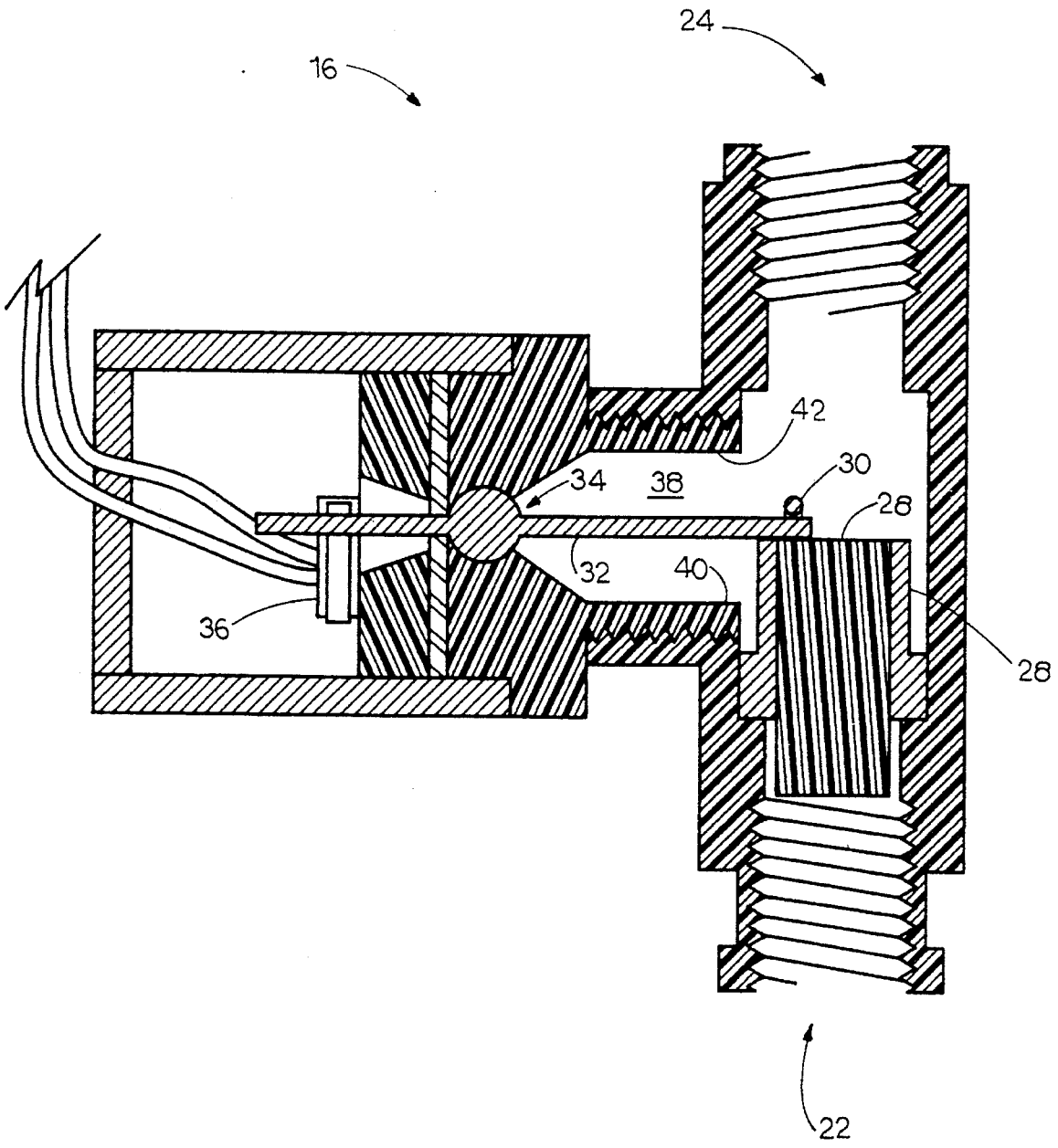
FIG. 3 is a cross sectional detail view of the flow switch, drawn to enlarged scale.

When not in use, no water flows through water heater 10, and no electrical power is consumed. Operation of the tankless water heater 10 is dependent upon a user opening a hot water tap (not shown), whereupon water pressure within the plumbing system (not shown) operates flow switch 16. Turning now to FIG. 3, flow switch 16 is seen to have inlet and outlet fittings 22 and 24, respectively. Fittings 22 and 24 are preferably threaded to enable ready conventional assembly. A plunger 26 is constrained by sleeve 28 to move only vertically, as seen in this view. A yoke 30 formed in plunger 26 retains an arm 32 in contact therewith. Arm 32 is pivotally mounted at 34, and, when it pivots, trips a limit switch 36 to complete a power circuit to the control system (described hereinafter).

Even slight displacement of plunger 26 by water flow enables water to flow into a chamber 38 formed in flow switch 16, and then on towards outlet fitting 24. This is enabled by construction of plunger 26, seen in greater detail in FIG. 6.

Vertical travel of arm 32, and therefore, vertical travel of plunger 26, are limited by interference at points 40 and 42 of the body of flow switch 16.

Figure 6:
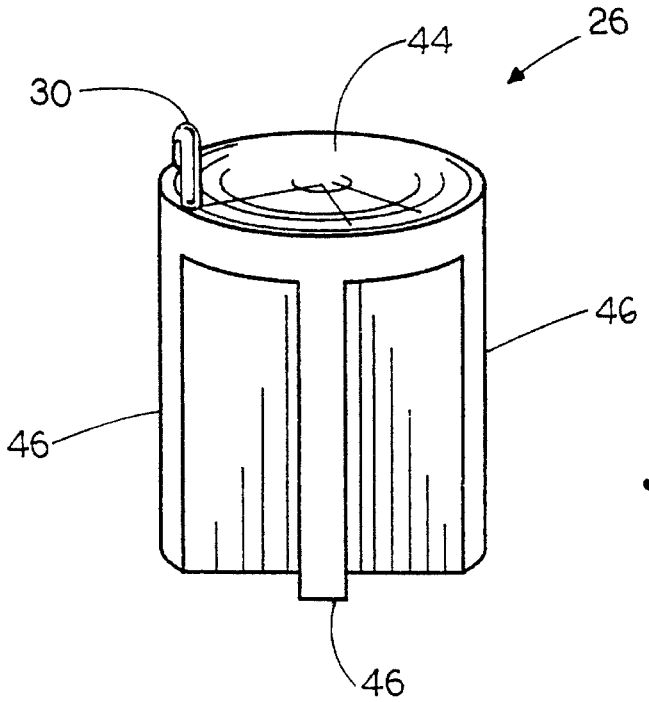
FIG. 6 is a perspective detail view of the flow switch plunger, drawn to enlarged scale.

Referring to FIG. 6, plunger 26 has a head 44 which prevents flow of water past plunger 26. Below head 44 are walls 46 which maintain plunger 26 centered and true within sleeve 28 (see FIG. 3), but which allow water to flow into chamber 38 (see FIG. 3).

Figure 4:
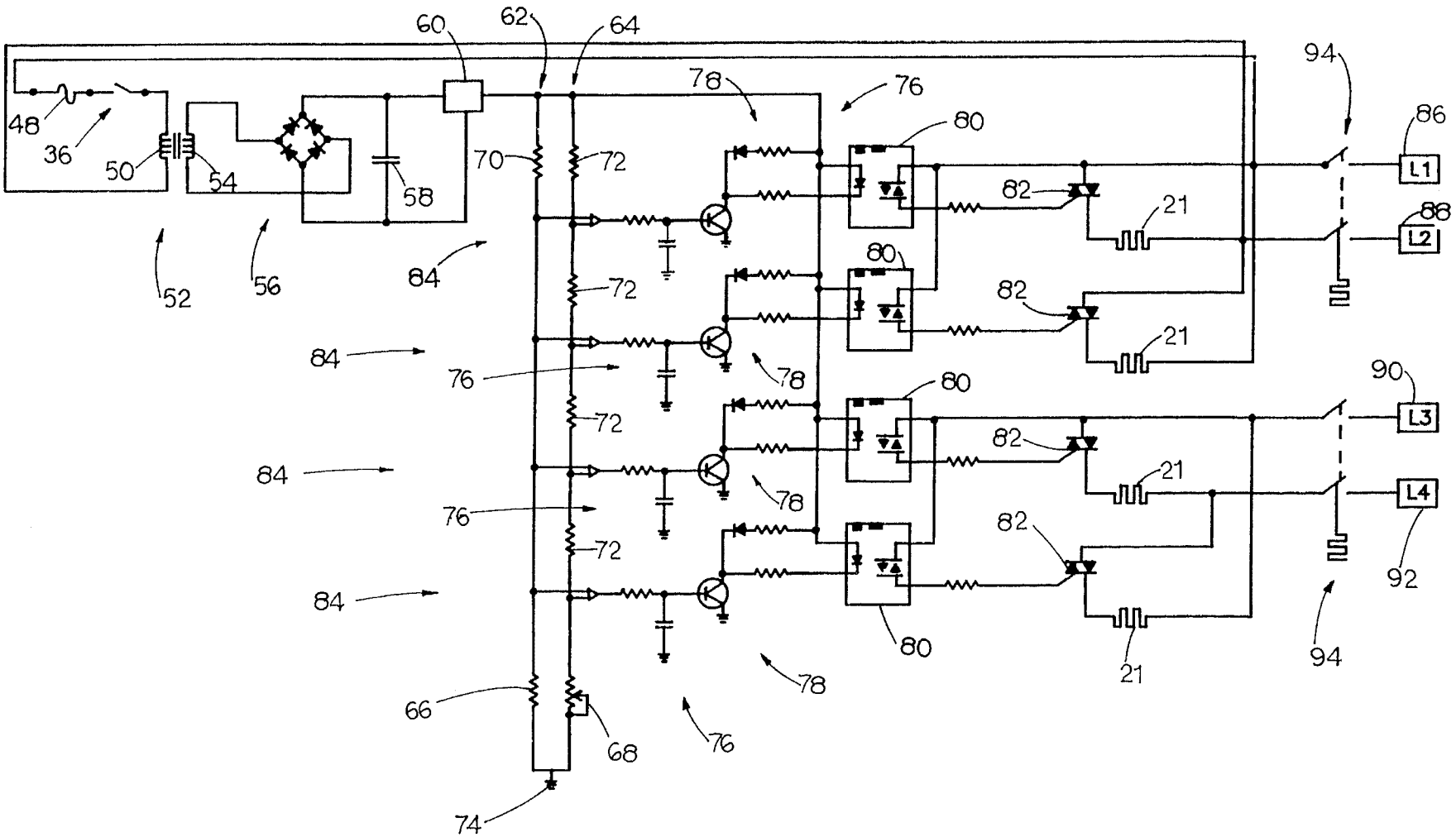
FIG. 4 is an electrical schematic of the novel water heater.

Operation of the control system will now be discussed, with reference to FIG.4. When limit switch 36 closes, AC power from one of the main power circuits completes a circuit, fused at 48, to the primary side 50 of a step-down transformer 52. The secondary side 54 of transformer 52 feeds AC power at reduced voltage to a bridge 56. Bridge 56 rectifies the reduced voltage AC power to DC power, which DC power is then conditioned by smoothing capacitor 58 and voltage regulator 60 to provide steady, limited voltage DC power to the rest of the control system. Thus, the AC source, transformer 52, bridge 56, smoothing capacitor 58, and voltage regulator 60 combine to provide a source of DC power for control purposes from the AC power circuit provided for heating. It will be appreciated that the electrical components employed herein are well known within the art, and need not be explained in detail herein. Accordingly, overall function of the control system will be summarized, and specific functions will not be explained in detail.

DC power then feeds two voltage divider circuits 62 and 64. First voltage divider circuit 62 includes a thermistor 66 in series therein, and the second voltage divider circuit includes a manually adjustable potentiometer 68 in series therein. Voltage divider circuit 62 includes a resistor 70 and divider circuit includes four resistors 72. Both voltage divider circuits 62, 64 are grounded at 74.

Four comparators 76 are connected to voltage divider circuits 62 and 64. Each comparator 76 monitors voltage divider circuit 64 at a different segment thereof, due to location of its respective connection to voltage divider circuit 64 relative to resistors 72. Each comparator 76 provides input controlling a driver 78, which in turn drives an optotriac 80, which in turn controls a power triac 82. Power triac 82 switches AC power to an associated heating element 21. Each electrically connected combination of one comparator 76, one driver 78, one optotriac 80, and one power triac 82 defines a power switching subcircuit 84.

In the illustrated embodiment, there are four power switching subcircuits 84 controlling four heating elements 21. In a preferred embodiment, heating elements 21 consume 5500 watts each, for a total heat output of 22 kilowatts. They are fed from two AC circuits having a potential of 240 volts, nominal, line to line. One AC circuit is connected to power terminals 86 and 88, and the other AC circuit is connected to power terminals 90 and 92. Power connected to flow switch 16 is arbitrarily taken from one AC circuit, in the present case connection being to terminals 86 and 88.

In the event of a problem leading to overheating of water within pressure vessel 12, overtemperature switches 94 provide two pole breaking of the 240 volt power circuits. In the preferred embodiment, snap action switches, in which a metallic element flexes when heated above a predetermined temperature, and separates appropriate contacts, serve well in this capacity. Either switch 94 will deenergize all downstream electrical components in the circuit being switched thereby. If both switches 94 trip, all power is removed from all downstream components.

Returning to FIG. 1, the location of major electrical components will be discussed. Terminal blocks 96 of various types are illustrated in their actual location, but serve merely for convenience in making necessary electrical connections in order to practice the present invention, and are not inherently important. Therefore, such terminal blocks are shown, but will not be discussed. Thermistor 66 is mounted at the top of pressure vessel flat front wall 20. Below are snap action switches 94 and a control board 98 supporting step-down transformer 52 and some electronic components. Power triacs 82 are seen to be among those components located at the lowest portion of pressure vessel front wall 20.

Controlling such a level of power imposes a significant cooling burden on power triacs 82. In the preferred embodiment, a triac manufactured by Teccor Company, Irving, Tex., model Q4040J9, which is rated by the manufacturer at 40 amperes, 240 volts, has proved satisfactory. Using this component, the cooling burden is the heat equivalent of 15 watts. Since the novel tankless water heater 10 is intended for mounting within a building wall or partition, convective cooling is unreliable at best.

Figure 5:
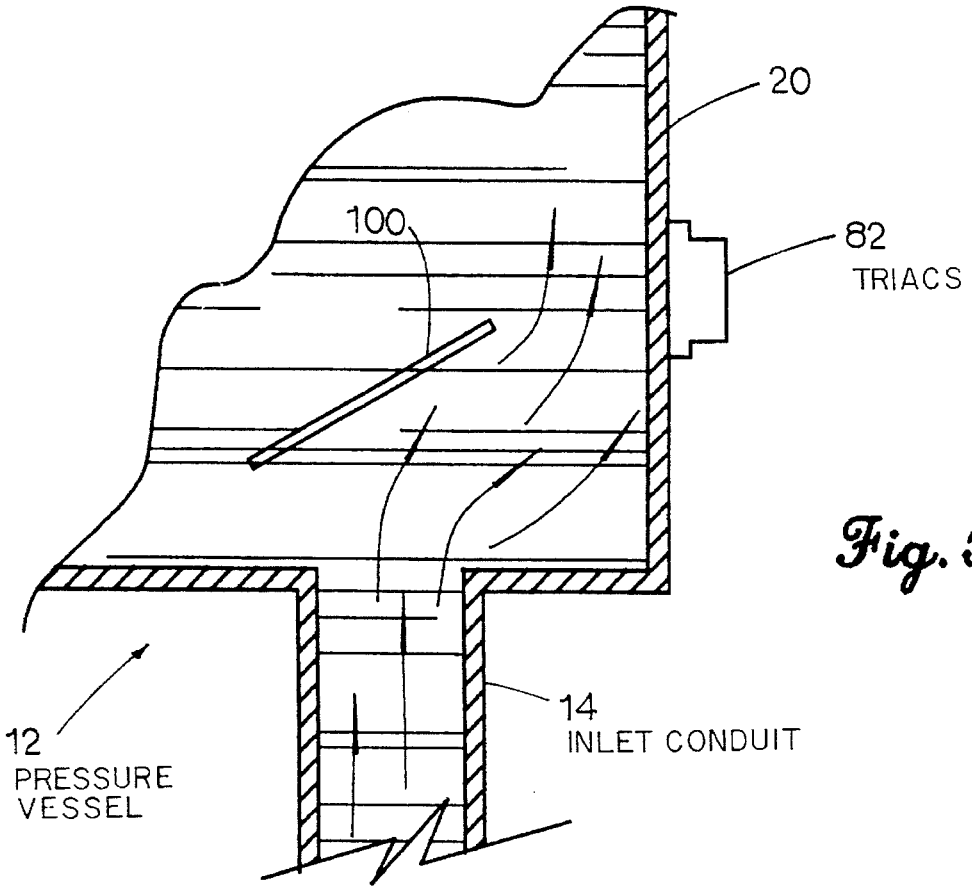
FIG. 5 is a diagrammatic, cross sectional detail view of a water diverting baffle within the pressure vessel of the novel water heater.

Mounting power triacs 82 on pressure vessel 12 solves this problem by providing a heat sink. To optimize the value of this heat sink, power triacs 82 are mounted at a point proximate inlet conduit 14, so that unheated water will hasten heat transfer. And, as seen in FIG. 5, a water diverting baffle 100 is mounted within pressure vessel 12 to direct water to flow directly against flat front wall 20, near power triacs 82.

It will thus be seen that a tankless water heater is provided which heats water responsive only to actual flow of water. Power is controlled by selectively and sequentially energizing heating elements 21 in four discrete steps, according to demand. If the control system should fail, and excessive heating occurs, thermally responsive switches 94 will shut off all power to both heating elements 21 and to the control system.

The present invention thus provides an extremely compact source of limitless heated water which utilizes no power when dormant, which responds quickly to demand, which provides maximum safety when exposed by removal of its cover, which prolongs the life of heat generating components, which avoids objectionable voltage spikes when energizing heating elements, which responds to any quantity of water flow, and which consumes power in proportion to demand.

It is to be understood that the present invention is not limited to the sole embodiment described above, but encompasses any and all embodiments within the scope of the following claims.

We claim:

1. An electrically operated tankless water heater for connection to AC electric power, said tankless water heater comprising:

a pressure vessel having a flat front wall for receiving, heating, and discharging water to be heated, an inlet conduit conducting unheated water into said pressure vessel, and an outlet conduit discharging heated water from said pressure vessel;

a plurality of electric heating elements axially disposed within said pressure vessel;

a flow switch attached to said inlet conduit exteriorly of said pressure vessel, said flow switch having a plunger displaced by water flowing into said tankless water heater, and means completing an electrical circuit to a control system, thereby providing power to and activating the control system; and a control system responsive to power being supplied thereto through said flow switch, said control system including:

a source of DC power for supplying control power, first and second voltage divider circuits each connected to said DC power source and to a ground, a thermally responsive variable resistor connected in series in said first voltage divider circuit and disposed to monitor and respond to temperature within said pressure vessel, and at least one power switching subcircuit comprising a comparator for monitoring said two voltage divider circuits and controlling a driver in response thereto, said driver responding to said comparator and driving an optotriac, said optotriac driven by said driver for controlling a power triac, and said power triac controlled by said optotriac for switching AC electric power to said plurality of electric heating elements.

2. The electrically operated tankless water heater according to claim 1, wherein all power triacs included in said at least one power switching subcircuit are mounted at a point on said pressure vessel flat front wall proximate said inlet conduit.

3. The electrically operated tankless water heater according to claim 2, said pressure vessel including therewithin a water diverting baffle directing unheated water entering through said inlet conduit to be directed to flow against said point on said pressure vessel flat front wall proximate said inlet conduit, whereby said all power triacs are cooled by causing unheated water to flow past all said power triacs prior to the unheated water being heated by said heating elements.

4. The electrically operated tankless water heater according to claim 1, said source of DC power comprising conductors connected to AC power, a step-down transformer for producing reduced AC voltage power from the AC power, a bridge converting said reduced voltage AC power to DC power, a smoothing capacitor for conditioning said DC power, and a voltage regulator for assuring a steady voltage output of conditioned DC power.

5. The electrically operated tankless water heater according to claim 1, the other of said first and second voltage divider circuits further including a manually adjustable potentiometer, whereby output temperature of said water heater is manually adjusted.

6. The electrically operated tankless water heater according to claim 1, further including a thermally responsive switch provided within said flat front wall, said thermally responsive switch providing a two pole break of AC power connected to at least one of said plurality of electric heating elements when water contained within said pressure vessel has a temperature exceeding a predetermined temperature thereby deenergizing said at least one of said plurality of electric heating elements.

7. The electrically operated tankless water heater according to claim 6, there being at least one said thermally responsive switch controlling the AC power connected to said tankless water heater, and wherein all AC power connected to said tankless water heater is controlled by said at least one thermally responsive switch.

8. The electrically operated tankless water heater according to claim 1, said flow switch further comprising means for constraining said flow switch plunger to move in the same direction as unheated water entering said pressure vessel, a pivotally mounted arm engaging said flow switch plunger, said arm pivoting in response to movement of said plunger due to water flow, and means for limiting pivot of said arm, and consequently, travel of said plunger due to water flow and to gravity in the absence of water flow, said plunger including a yoke for surroundably retaining said arm in engagement therewith.

9. An electrically operated tankless water heater for connection to AC electric power, said tankless water heater comprising:

a pressure vessel having a flat front wall for receiving, heating, and discharging water to be heated, an inlet conduit conducting unheated water into said pressure vessel, and an outlet conduit discharging heated water from said pressure vessel;

a plurality of electric heating elements axially disposed within said pressure vessel;

a flow switch attached to said inlet conduit exteriorly of said pressure vessel, said flow switch having a plunger displaced by water flowing into said tankless water heater, and means completing an electrical circuit to a control system, thereby providing power to and activating the control system, said flow switch comprising, means for constraining said flow switch plunger to move in the same direction as unheated water entering said pressure vessel, a pivotally mounted arm engaging said flow switch plunger, said arm pivoting in response to movement of said plunger due to water flow, means for limiting pivot of said arm, and consequently, travel of said plunger due to water flow and to gravity in the absence of water flow, said plunger including a yoke for surroundably retaining said arm in engagement therewith; and a control system responsive to power being supplied thereto through said flow switch, said control system including, a source of DC power for supplying a control power, comprising conductors connected to AC power, a step-down transformer for producing reduced AC voltage power from the AC power, a bridge converting said reduced voltage AC power to DC power, a smoothing capacitor for conditioning said DC power, and a voltage regulator for assuring a steady voltage output of conditioned DC powers, first and second voltage divider circuits each connected to said DC power source and to a ground, a thermally responsive variable resistor connected in series in one of said first and second voltage divider circuits and disposed to monitor and respond to temperature within said pressure vessel, the other of said first and second voltage divider circuits further including a manually adjustable potentiometer, whereby output temperature of said water heater is manually adjusted, at least one power switching subcircuit comprising a comparator for monitoring said two voltage divider circuits and controlling a driver in response thereto, said driver responsive to said comparator and driving an optotriac, said optotriac driven by said driver and controlling a power triac, said power triac switching AC electric power to said heating elements under the control of said optotriac, wherein all power triacs included in said at least one power switching subcircuit are mounted at a point on said pressure vessel flat front wall proximate said inlet conduit, and at least one thermally responsive switch controlling the AC power connected to at least one of said plurality of electric heating elements, said at least one thermally responsive switch providing two pole break of AC power connected to said at least One of said plurality of electric heating elements when water contained within said pressure vessel has a temperature exceeding a predetermined temperature, thereby deenergizing said at least one of said plurality of electric heating elements, said pressure vessel including therewithin a water diverting baffle directing unheated water entering through said inlet conduit to be directed to flow against said point on said pressure vessel flat front wall proximate said inlet conduit, whereby said power triacs are cooled by causing unheated water to flow past all said power triacs prior to the unheated water being heated by said plurality of electric heating elements.

* * * * *